US007151839B2

(12) United States Patent
Niederdränk

(10) Patent No.: US 7,151,839 B2
(45) Date of Patent: Dec. 19, 2006

(54) MODULAR HEARING AID DEVICE

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 169 days.

(21) Appl. No.: 10/608,589

(22) Filed: Jun. 27, 2003

(65) Prior Publication Data

US 2004/0052388 A1 Mar. 18, 2004

(30) Foreign Application Priority Data

Jun. 27, 2002 (DE) ..... 102 28 828

(51) Int. Cl.
*H04R 25/00* (2006.01)

(52) U.S. Cl. ..... 381/324; 381/313; 381/322; 381/328; 381/330

(58) Field of Classification Search ..... 381/312, 381/313, 324, 328, 329, 330, 356, 369, 60, 381/318, 327, 322; 181/130, 135
See application file for complete search history.

(56) References Cited

U.S. PATENT DOCUMENTS 5,204,917 A 4/1993 Arndt et al.
5,878,147 A * 3/1999 Killion et al. ..... 381/313
6,154,546 A * 11/2000 Uvacek ..... 381/60
6,718,043 B1 * 4/2004 Boesen ..... 381/314
2003/0070868 A1 * 4/2003 Kolpe et al. ..... 181/135
2003/0115068 A1 * 6/2003 Boesen ..... 704/277

FOREIGN PATENT DOCUMENTS

DE G 88 04 743.1 9/1989
DE 196 35 229 3/1998
DE 198 52 758 5/2000

* cited by examiner

*Primary Examiner*—Sinh Tran
*Assistant Examiner*—Brian Ensey
(74) *Attorney, Agent, or Firm*—Schiff Hardin LLP

(57) ABSTRACT

The invention is directed to a modular hearing aid device having a microphone module that comprises a microphone module housing and at least one microphone, and having a hearing aid device module that comprises a hearing aid device module housing, whereby the microphone module housing supplements the hearing aid device module housing to form a housing of the hearing aid device having a uniform effect, and whereby the microphone module and the hearing aid device module are detachably connected, and whereby the hearing aid device module comprises at least one microphone.

13 Claims, 2 Drawing Sheets

MODULAR HEARING AID DEVICE

BACKGROUND OF THE INVENTION

1. Field of the Invention

The invention is directed to a modular hearing aid device having a microphone module that comprises a microphone module housing and at least one microphone, and having a hearing aid device module that comprises a hearing aid device module housing, whereby the microphone module housing supplements the hearing aid device module housing to form a housing of the hearing aid device having a uniform effect, and whereby the microphone module and the hearing aid device module are detachably connected.

2. Description of the Related Art

A modular structure of a hearing aid device is known. The modules are usually located in the inside of the hearing aid device, and the modules are surrounded by the housing of the hearing aid device. When a module is attached to the outside, then this module has the job of improving the functionality. This module can be more easily replaced in the case of a battery module. In the case of a microphone module, for example, this can be adapted to the existing acoustic situation by using a spatial alignment.

A modular hearing aid device of the species initially cited is disclosed by German Patent Document DE 8804743 U1. The individual parts of this device—microphone, amplifier, volume control, earphone and battery housing chamber—are fashioned as modules that are joined to form a common housing and connected to one another by mechanical screw-type, plugin or catch connections.

U.S. Pat. No. 5,204,917 discloses a modularly constructed hearing aid device that comprises the following modules: a microphone module, a loudspeaker module, an amplifier module and a battery module. The modules are clad with common cover plates.

A further modular hearing aid device is disclosed by German Patent Document DE 198 52 758 A1, in which a microphone system is constructed in the form of a module and is secured to a carrier that is rotatably and pivotably attached to the hearing aid housing. As a result, the microphone system can be directed, for example, to a speaker for improving the directional characteristic.

German Patent Document DE 196 35 229 A1 discloses a microphone module, whereby the microphone are equipped with a sound channel. This improves the protection of the microphones against dirt, simplifies the arrangement of the operating elements and enables an effective shielding given a constantly good directional effect of the microphone. The microphone module is attached to the housing of the hearing aid device.

Attached microphone modules have the disadvantage that the hearing aid devices lose their compact structure for the benefit of functionality.

SUMMARY OF THE INVENTION

The invention is based on the object of providing an optimal employment of a microphone module in a modular hearing aid device.

In a modular hearing aid device of the species initially cited, this object inventively achieved in that the hearing aid device module comprises at least one microphone.

Differing from applied microphone modules, the invention provides that the microphone module be integrated in the hearing aid device such that the microphone module housing becomes a part of the housing of the hearing aid device. As a result, the hearing aid device has both the advantage of the compact structure having a housing that makes a uniform impression/effect as well as the advantage of a modular design concept wherein the microphone module can be easily replaced. Additionally, the housing making the uniform impression lends the hearing aid device an aesthetic appearance. The uniform effect may be a shape that forms a cohesive whole, possibly having a traditional hearing aid shape and/or minimizes the geometric curves or elements of the device. A further advantage is the service friendliness of such a structure that, for example, allows an uncomplicated replacement of the microphone module or assures simple access to the microphone and to the hearing aid device module.

DESCRIPTION OF THE DRAWINGS

The explanation of three exemplary embodiments of the invention follows with reference to FIGS. 1 through 3.

DETAILED DESCRIPTION OF THE PREFERRED EMBODIMENTS

Figure 1:
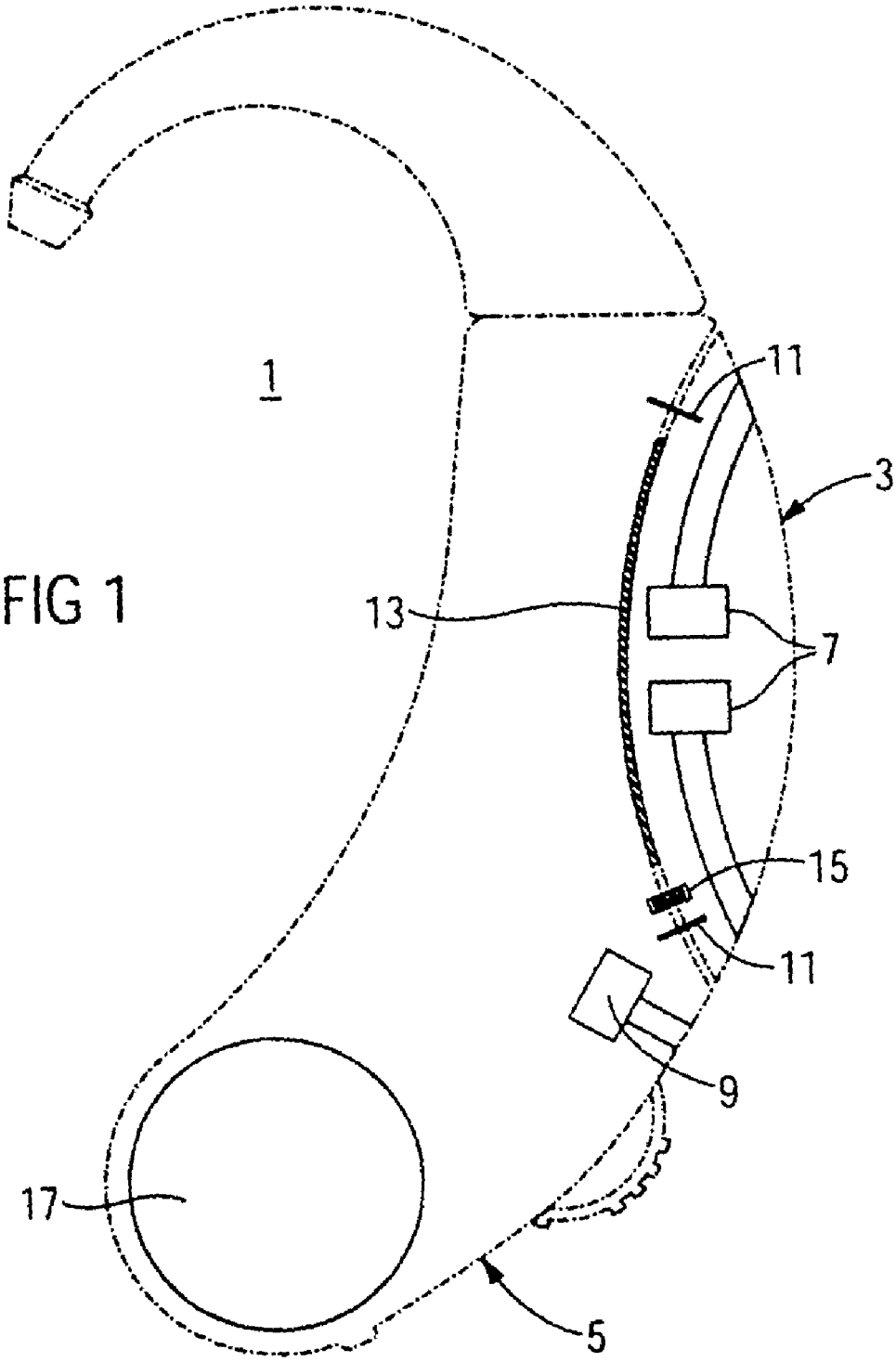
FIG. 1 is a pictorial diagram of a behind-the-ear hearing aid device composed of a microphone module and of a hearing aid device module.

Various embodiments of the invention are envisioned along with their associated advantages.

Dependent on the execution of the hearing aid device module housing, a large opening in the hearing aid device module can become free after the removal of the microphone module, this large opening being then used for maintenance. A particular advantage of the embodiment is comprised in the possibility of using the modular structure for combining various microphone modules with a hearing aid device module via a simple connection technique, for example, a bayonet closure and/or an electronic interface.

A hearing aid device is thus obtained that can meet the greatest variety of acoustic demands. Thus, the hearing aid device module can also be implemented as a basic hearing aid device that, for example, comprises a permanently installed, omnidirectional microphone. Using different microphone modules that, for example, comprise a directional microphone system, the basic hearing aid device can be expanded to form a hearing aid device having a greater performance capability. As a result, the hearing aid device user can continue to use his/her accustomed hearing aid device, but with a higher quality microphone system adapted to the respective situation. Further, a modular hearing aid device of the invention offers the advantageous possibility of not only acousto-mechanically optimizing the individual modules but of also acousto-mechanically directing the connection of the modules to an optimum oscillation damping and decoupling of the modules. The optimized connection can then be used with various microphone modules. In order to contribute to a good wearing comfort, the transition between the housings of the microphone module and the hearing aid device module can, for example, be implemented at least primarily form-fitting and flush. This would be diminished by potential steps at the housing that are in contact with the skin of the user.

In one embodiment, the microphone module and hearing aid device module are connected in oscillation-damped fashion. This prevents the transmission of oscillations that proceed from the earphone onto the microphone modules and, thus, suppresses feedback between earphone and microphone.

In an especially advantageous development, the fastening points of the microphone module to the hearing aid device module lie at at least one oscillatory node or at least in its proximity. Structure-borne acoustic oscillations of the housing are thus hardly transmitted onto the microphone module since the oscillatory amplitude is clearly reduced in the region of the oscillatory nodes. Defined connecting points allow the fastening of the microphone module to the hearing aid device module to be designed in an oscillation-oriented fashion in this way. To this end, the oscillatory nodes of the characteristic oscillations of the hearing aid device module housing are determined, for example, with a laser vibrometer or with the assistance of speckle holography. Subsequently, the microphone module is secured to at least one of the oscillatory nodes of the hearing aid device module housing. The fastening can also occur in the region of the oscillatory nodes. A damping material is preferably applied in the region of the antinodes (maximum amplitudes). Such an oscillation-damped suspension of the microphone module can, for example, produce an attenuated vibration transmission or a uniform oscillation of all microphones. Additionally, the microphone module can be acoustically optimized, for example, to slight characteristic oscillations.

In another embodiment, damping material is attached between the microphone module and hearing aid device module. Specifically in the region of antinodes, the oscillation-damping material here can suppress the transmission of oscillations from the hearing aid device module onto the microphone module.

When various microphone modules are secured to the hearing aid device module, then very little about the oscillation transmission onto the microphone modules is changed since the fastening points continue to lie at oscillatory nodes of the structure-borne acoustic oscillations of the hearing aid device module, and the oscillation-damping material that is advantageously located in the region of the antinodes can also be retained.

In another embodiment, the microphone module can be used simultaneously with a microphone of the hearing aid device module. This has the advantage that the microphones of the microphone module and of the hearing aid device module can be electronically interconnected and, for example, thus form a directional microphone system with one another.

In another embodiment, the microphone of the hearing aid device module is switched off as soon as the connection between microphone module and the hearing aid device module has been produced. For example, this is advantageous when the microphone module already comprises a directional microphone system that exceeds the quality of the microphone of the hearing aid device module.

In a particular embodiment, the hearing aid device module is fashioned for connection to various microphone modules. This enables a versatile use of the hearing aid device dependent on the situation and demands of the hearing aid user. A signal processing unit in the hearing aid device module can thereby recognize the respective microphone module and implement a processing of the acoustic signals in conformity with the installed microphones.

In an especially advantageous embodiment, the microphone module is connected to the hearing aid device module via an electronic interface. This can be standardized, so that a simple replacement of various microphone modules is possible. For example, the electronic interface can be based on a flex board or on molded interconnect devices (MID) technology, a technology for manufacturing three-dimensional injection molded component parts.

The invention can be applied in all known types of hearing aid devices, for example in hearing aid devices worn behind the ear, in hearing aid devices worn in the ear, implantable hearing aid devices, hearing aid device systems or pocket hearing aids.

Referring now to the drawings, FIG. 1 shows a behind-the-ear hearing aid device 1 that comprises a microphone module 3 and a hearing aid device module 5. The microphone module 3 comprises two microphones 7 that each has an acoustic channel. Together, the microphones 7 form a directional microphone system. It is beneficial to position the microphones 7 in the microphone modules 3 with clearly offset sound admissions. Alternatively, the microphone module can comprise inputs from individual acoustic sensors up through directional microphones of a higher order.

The EMC properties can be improved by integrating various electronic components into the microphone module in the proximity of the microphone. A undirected microphone 9 is also located in the hearing aid device module 3. The fastening of the microphone module 3 ensues via two fastening pins 11 that engage at two oscillatory nodes of the characteristic oscillations of the hearing aid device module 5. A damping material 13 may be situated between the two modules in the region of the highest oscillatory amplitude, i.e., the antinodes. The microphone module 3 may be electronically connected to the hearing aid device module 5 via plug-type contacts 15. A signal processing unit 17 in the hearing aid device module 5 implements a processing of the acoustic signals that is adapted to the microphone module 3.

As soon as the two modules are connected, the pickup of acoustic signals only ensues via the directional microphone system in a first embodiment. The undirected microphone 9 of the hearing aid device module 5 is deactivated with the connection.

In a second embodiment, the microphones 7 and the microphone 9 are operated together for the pickup of acoustic signals. In one embodiment, these microphones can also be electronically interconnected to form a directional microphone. For example, the signal processing 17 can be programmed such that, first, it recognizes the respective microphone module 3 and, second, always implements the optimum algorithm for various combinations of microphone modules 3 with microphones 9 and decides itself regarding the microphones to be employed. The housing of the behind-the-ear device 1 comprises no elevations in the flush transition region between the two modules. In a possible version, the housing of the hearing aid device module 5 can remain open in the region in which the microphone module 3 is applied and, thus, can enable a good access to the inside area. The housing of the microphone module 3 can also be an open housing that comprises a shell-shaped housing only in the outer region for completing the housing of the behind-the-ear hearing aid 1.

Figure 2:
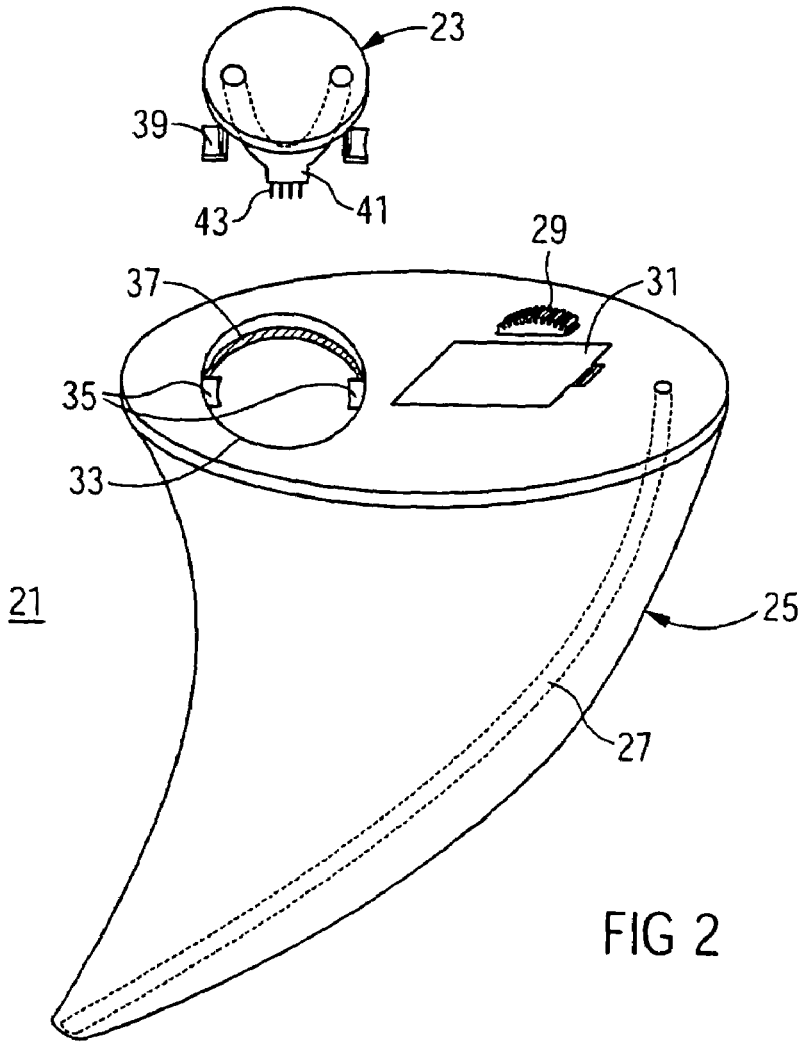
FIG. 2 is a pictorial diagram of an in-the-ear hearing aid device that is likewise composed of a microphone module and a hearing aid device module.

FIG. 2 shows an in-the-ear hearing aid device 21 that also comprises a microphone module 23 and a hearing aid device module 25. A aeration bore 27, a volume control 29 and a battery compartment 31 are situated in the hearing aid device module 25. A recess 33 in the hearing aid device module 25 can accept the microphone module 23. The latter is secured to the hearing aid device module 25 with a fast closure, whereby the hooks 39 may engage behind the fastening plates 35. The two fastening plates 35 are situated at oscillatory nodes of the characteristic oscillations of the structure-borne sound of the hearing aid device module 25. A damping material 37 of, for example, rubber can be applied in the remaining seating region. A direction-sensitive gradient microphone 41 that is connected to the electronics of the hearing aid device module via plug-type contacts 43 may be situated at the microphone module.

Figure 3:
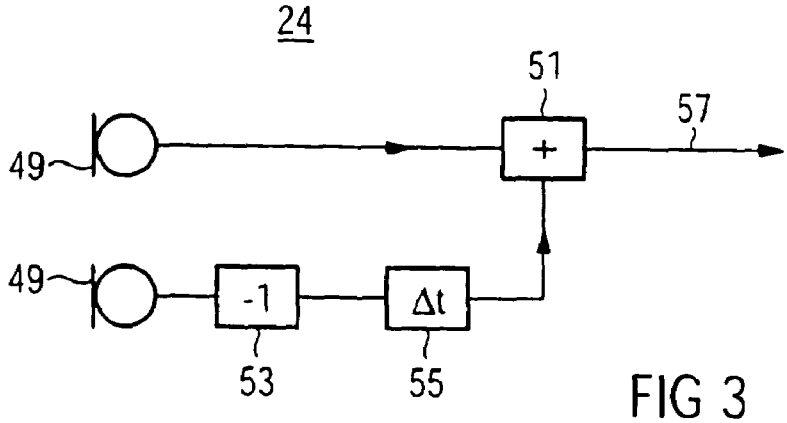
FIG. 3 is a schematic block diagram of a directional microphone system composed of two microphones that are electronically interconnected with one another.

FIG. 3 shows a block diagram of the functioning of an embodiment of a directional microphone system. The signals of two undirected microphones 49 are interconnected to one another via an adder element 51 after one of the two signals were inverted with an inverter 53 and delayed by means of a delay element 55. The signal available at the signal output 57 is then dependent on the relative position of the sound source via a vis the undirected microphones 49.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

1 behind-the-ear device
3 microphone module
5 hearing aid device module
7 microphone
9 undirected microphone
11 fastening pins
13 damping material
15 plug-type contacts
17 signal processing unit
21 in-the-ear hearing aid device
23 microphone module
24 directional microphone system
25 hearing aid device module
27 aeration tube
29 volume control
31 battery housing
33 recess
35 fastening plate
37 damping material
39 fastening hooks
41 gradient microphone
43 plug-type contacts
49 undirected microphone
51 adder element
53 inverter
55 delay element
57 signal output

What is claimed is:

1. A modular hearing aid device, comprising:

a microphone module that comprises a microphone module housing and at least one microphone; and a hearing aid device module that comprises a hearing aid device module housing and at least one microphone;

wherein the microphone module housing supplements the hearing aid device module housing to form a housing of the hearing aid device having a uniform effect, the microphone module and the hearing aid device module being detachable; and an external surface of the microphone module housing has a curvature identical to an external surface of the hearing aid device module housing at outer edge boundaries of the microphone module housing when the microphone module is attached to the hearing aid device module.

2. The modular hearing aid device according to claim 1, further comprising:

an attenuation-damped connection for connecting the microphone module and the hearing aid device module.

3. A modular hearing aid device, comprising:

a microphone module that comprises a microphone module housing and at least one microphone;

a hearing aid device module that comprises a hearing aid device module housing and at least one microphone; and an attenuation-damped connection for connecting the microphone module and the hearing aid device module;

wherein the microphone module housing supplements the hearing aid device module housing to form a housing of the hearing aid device having a uniform effect, the microphone module and the hearing aid device module being detachably connectable;

an external surface of the microphone module housing has a curvature identical to an external surface of the hearing aid device module housing at outer edge boundaries of the microphone module housing when the microphone module is attached to the hearing aid device module; and the attenuation-damped connection is arranged at at least one oscillatory node of characteristic oscillations of the hearing aid device module housing.

4. The modular hearing aid device according to claim 2, wherein the attenuation-damped connection comprises a damping material.

5. A modular hearing aid device, comprising:

a microphone module that comprises a microphone module housing and at least one microphone; and a hearing aid device module that comprises a hearing aid device module housing and at least one microphone;

wherein the microphone module housing supplements the hearing aid device module housing to form a housing of the hearing aid device having a uniform effect, the microphone module and the hearing aid device module being detachably connectable; and the at least one microphone of the microphone module is a directional microphone.

6. The modular hearing aid device according to claim 1, wherein the microphone module comprises microphones.

7. A modular hearing aid device, comprising:

a microphone module that comprises a microphone module housing and at least one microphone; and a hearing aid device module that comprises a hearing aid device module housing and at least one microphone;

wherein the microphone module housing supplements the hearing aid device module housing to form a housing of the hearing aid device having a uniform effect, the microphone module and the hearing aid device module being detachably connectable;

the microphone module comprises microphones; and the microphones in the microphone module form a directional microphone system.

8. The modular hearing aid device according to claim 1, wherein the microphone module is configured to be simultaneously employed with the microphone of the hearing aid device module.

9. A modular hearing aid device, comprising:

a microphone module that comprises a microphone module housing and at least one microphone; and a hearing aid device module that comprises a hearing aid device module housing and at least one microphone;

wherein the microphone module housing supplements the hearing aid device module housing to form a housing of the hearing aid device having a uniform effect, the microphone module and the hearing aid device module being detachably connectable;

an external surface of the microphone module housing has a curvature identical to an external surface of the hearing aid device module housing at outer edge boundaries of the microphone module housing when the microphone module is attached to the hearing aid device module; and the modular hearing aid device is configured such that the microphone of the hearing aid module is deactivated when the microphone module is connected to the hearing aid module.

10. The modular hearing aid device according to claim 1, wherein the hearing aid device module is configured to accept various microphone modules that respectively comprise different acoustic and/or electronic properties.

11. The modular hearing aid device according to claim 1, wherein the microphone module comprises an electronic interface to the hearing aid device module.

12. The modular hearing aid device according to claim 1, wherein the microphone module microphone is acoustically connected via an air interface to receive sound signals emanating externally from the hearing aid device.

13. A modular hearing aid device, comprising:

a microphone module that comprises a microphone module housing and at least one microphone; and a hearing aid device module that comprises a hearing aid device module housing and at least one microphone;

wherein the microphone module housing supplements the hearing aid device module housing to form a housing of the hearing aid device having a uniform effect, the microphone module and the hearing aid device module being detachably connectable; and the microphone module comprises substantially a same shape and volume as a gap within the hearing aid device module.

* * * * *